US007992404B2

(12) United States Patent
Su

(10) Patent No.: US 7,992,404 B2
(45) Date of Patent: Aug. 9, 2011

(54) WINDOW AIR CONDITIONER WITH EASY INSTALLATION METHOD

(75) Inventor: Kuo Jui Su, Van Nuys, CA (US)

(73) Assignee: Kuo Jui Su, Van Nuys, CA (US)

( * ) Notice: Subject to any disclaimer, the term of this patent is extended or adjusted under 35 U.S.C. 154(b) by 274 days.

(21) Appl. No.: 11/973,797

(22) Filed: Oct. 9, 2007

(65) Prior Publication Data

US 2008/0083240 A1 Apr. 10, 2008

Related U.S. Application Data

(60) Provisional application No. 60/850,421, filed on Oct. 10, 2006.

(51) Int. Cl.
*F25D 23/12* (2006.01)

(52) U.S. Cl. ..... 62/262; 62/291

(58) Field of Classification Search ..... 62/262, 62/263, 272, 280, 291, 188
See application file for complete search history.

(56) References Cited

U.S. PATENT DOCUMENTS 3,176,474 A * 4/1965 Abbott ..... 62/280
5,582,025 A * 12/1996 Dubin et al. ..... 62/262
6,568,201 B1 * 5/2003 Cur et al. ..... 62/262

* cited by examiner

*Primary Examiner* — Mohammad Ali

(57) ABSTRACT

A window air conditioner includes an indoor housing, an outdoor housing, an air conditioning unit including a first unit for removing heat from indoors at the indoor housing, a second unit for releasing the heat to outdoors at the outdoor housing, and a power control panel provided at the indoor housing to control the first and second units; and a connecting rod extended between the indoor housing and the outdoor housing, wherein the connecting rod serves as a bridge for suspendedly hanging the air conditioning unit at the window frame at a position that the indoor housing is supported at an interior side of the window frame while the outdoor housing is supported at an exterior side of the window frame.

8 Claims, 5 Drawing Sheets

WINDOW AIR CONDITIONER WITH EASY INSTALLATION METHOD

CROSS REFERENCE OF RELATED APPLICATION

This is a non-provisional application of a provision application having an application No. 60/850,421 and a filing date of Oct. 10, 2006.

BACKGROUND OF THE PRESENT INVENTION

1. Field of Invention

This invention relates to the window type of room air conditioner with unique features allowing for easy installation and better noise reduction.

2. Description of Related Arts

The conventional window type of room air conditioners (Window AC) are composed of a compressor and condenser module, evaporator module and electricity panel which are encased in a housing. These Window ACs are typically installed over a window or by creating an opening in a wall for the Window AC to slide through and be affixed in the hole. The advantage of the window AC is that the user can choose to install the AC unit himself if he decides to save cost on installation. The disadvantage is that the installation of the Window AC in the window is aesthetically unpleasing and often requires the window to be closed at all times in order to support the AC. Another disadvantage is that much of the noise produced by the compressor and condenser module of the AC unit travels into the room and thus can be quite noisy.

If the compressor and condenser module were placed in a housing to be installed outside of the room and the evaporator module and the electricity panel were placed in a separate housing to be installed inside of the room, the air conditioner (AC) unit becomes a split type of air conditioner. The placement of the compressor and condenser outside the room prevents the noise from traveling inside. However, such configuration requires a professional technician to connect the refrigerant tubes and the electricity lines between the two housings. In many countries where labor cost is low, the split type of AC is very commonly used. In The United States, the popularity of Split AC has not been wide-spread due to the high installation cost. As a result, the most common type of AC purchased by the US consumers is the regular type window AC which can be installed by the users themselves if they choose to.

The present invention addresses the noise and installation problems by designing a new type of window AC. This invention is not the split type of AC but carries a similar advantage of reduction in noise. In addition, the new type of AC can be easily installed by the user. In fact, it's easier to install the new invention than a conventional Window AC, which still requires the user to do heavy work such as drilling a hole in the wall and lifting and supporting the AC unit while trying to fit the AC in the hole. With the advantages such as noise reduction and easy installation, the new invention is able to attract users seeking for quiet ACs and/or ACs that are very easy to install. The new invention should easily find popularity among consumers in countries where labor cost for AC installation is high.

SUMMARY OF THE PRESENT INVENTION

The main purpose of the present invention is to make it possible for AC users to purchase and install a Window AC without having to pay a fee for installation. Furthermore, the present invention finds a solution in improving noise reduction when the AC is turned on. This reduction in noise is achieved by placing the compressor and condenser module in an outdoor housing and the evaporator module and the electricity panel in an indoor housing. The indoor and outdoor housings are separate casings that are united by a connecting rod to create one complete AC unit. The connecting rod, which is about an inch in width and height, serves as an anchor to support and suspend the AC unit from the window frame by attaching its ends to the tops of the indoor and outdoor housings. In addition to serving as an anchor, the hollow inner part of the rod functions as a channel through which the power lines, refrigerant tubes and condensate lines run between the two housings. A crucial advantage of this invention is hat the AC unit can be installed simply by placing the rod over the sill or frame of a window. As such, the outdoor and indoor housings hanging from the opposite ends of the rod are separated by the wall to achieve noise reduction. The present invention is suitable for installation over horizontal sliding windows. When installing the present invention, one positions the connecting rod at the furthest end on the open side of the window to enable the window to shut most of the way. Since the rod is only about 1 inch wide, there will be only a tiny gap about the width of the connecting rod when the window is closed. The manufacturer is encouraged to supply, as part of the complete product package, a strip made of suitable material to close up the gap.

The present invention is also suitable for installation over windows that open in an upward, downward motion. When installing over such windows, the connecting rod can be positioned anywhere over the sill of the window. A strip made of suitable material can also be used to close up the gap between the sill and the bottom of the window panel in a closed window.

Many apartments have either one or no AC installed. Often renters or occupiers who would like to install one or more ACs in their apartment unit are either frustrated by the cost of hiring a technician for installation or feel daunted by either a complete lack of knowledge or the complexity of the installation process. The present invention makes it easy for apartment renters or occupiers to install one or more AC units themselves. The quietness of the AC unit creates much less disturbance and allows users to feel more comfortable and sleep better. At the same time, the compactness and easy-to-carry design of the invention makes it easy to uninstall and relocate the unit. The various functionality and advantages of the present invention mentioned above are not found in other types of air conditioner. Another element to emphasize is that there's no installation costs involved which allows any user to install the AC units themselves without having to hire a technician for installation. As such, there's a great possibility of its popularity among consumers. The objects and advantages of the invention may be better understood and will become apparent from the accompanying drawings.

DETAILED DESCRIPTION OF THE PREFERRED EMBODIMENT

Figure 1:
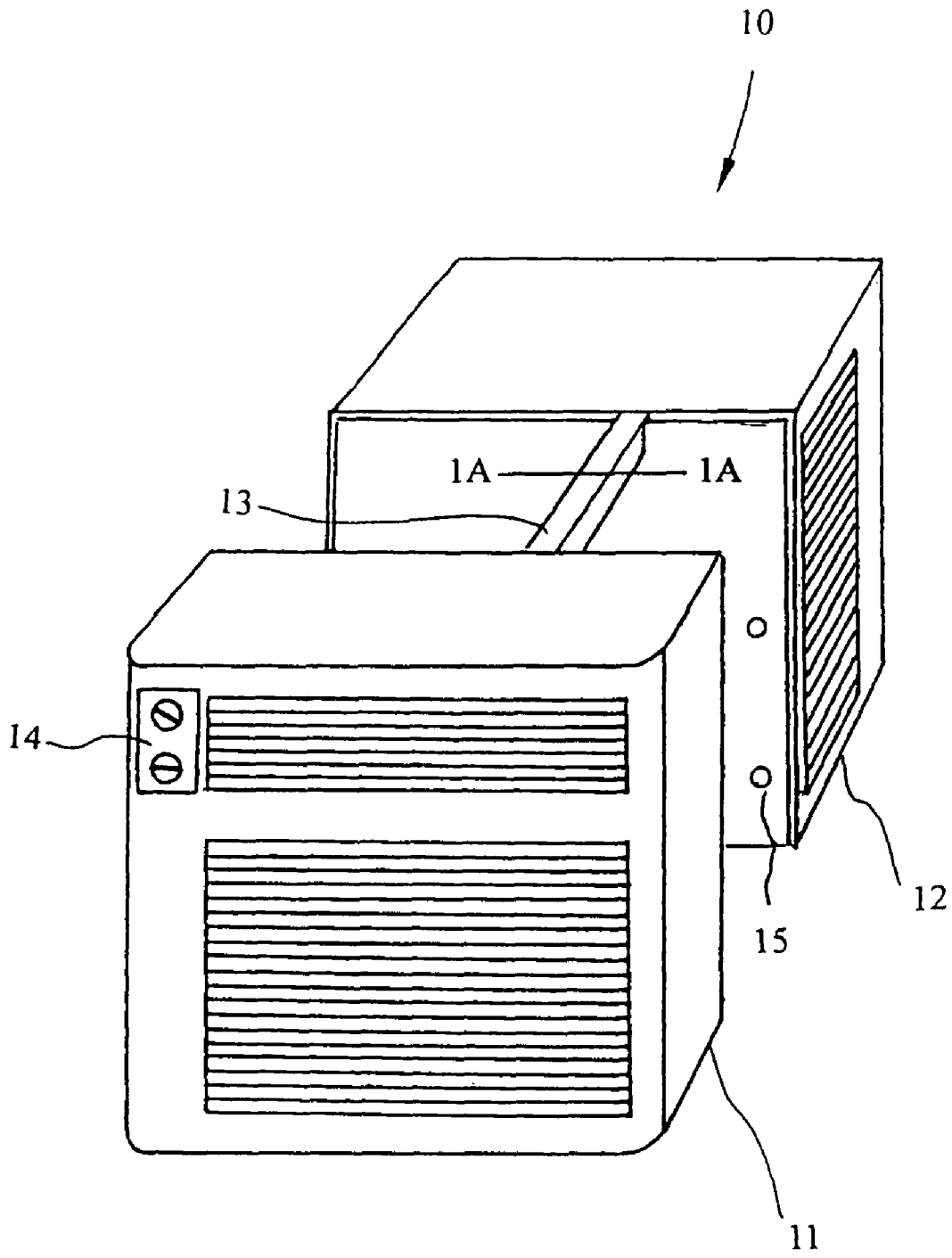
FIG. 1 illustrates a room air conditioner according to the present invention.

FIG. 1 illustrates a room air conditioner (10), according to the present invention, includes an indoor housing (11) and an outdoor housing (12) locked in position by a connecting rod (13) to become one complete room air conditioner (10). The indoor housing (11) comprises a power control panel (14) and an evaporate module, including an evaporator coil, a fan, and a fan motor. The outdoor housing 12 comprises a compressor and a condenser module which includes a condenser coil tube, a fan and a fan motor.

Figure 2:
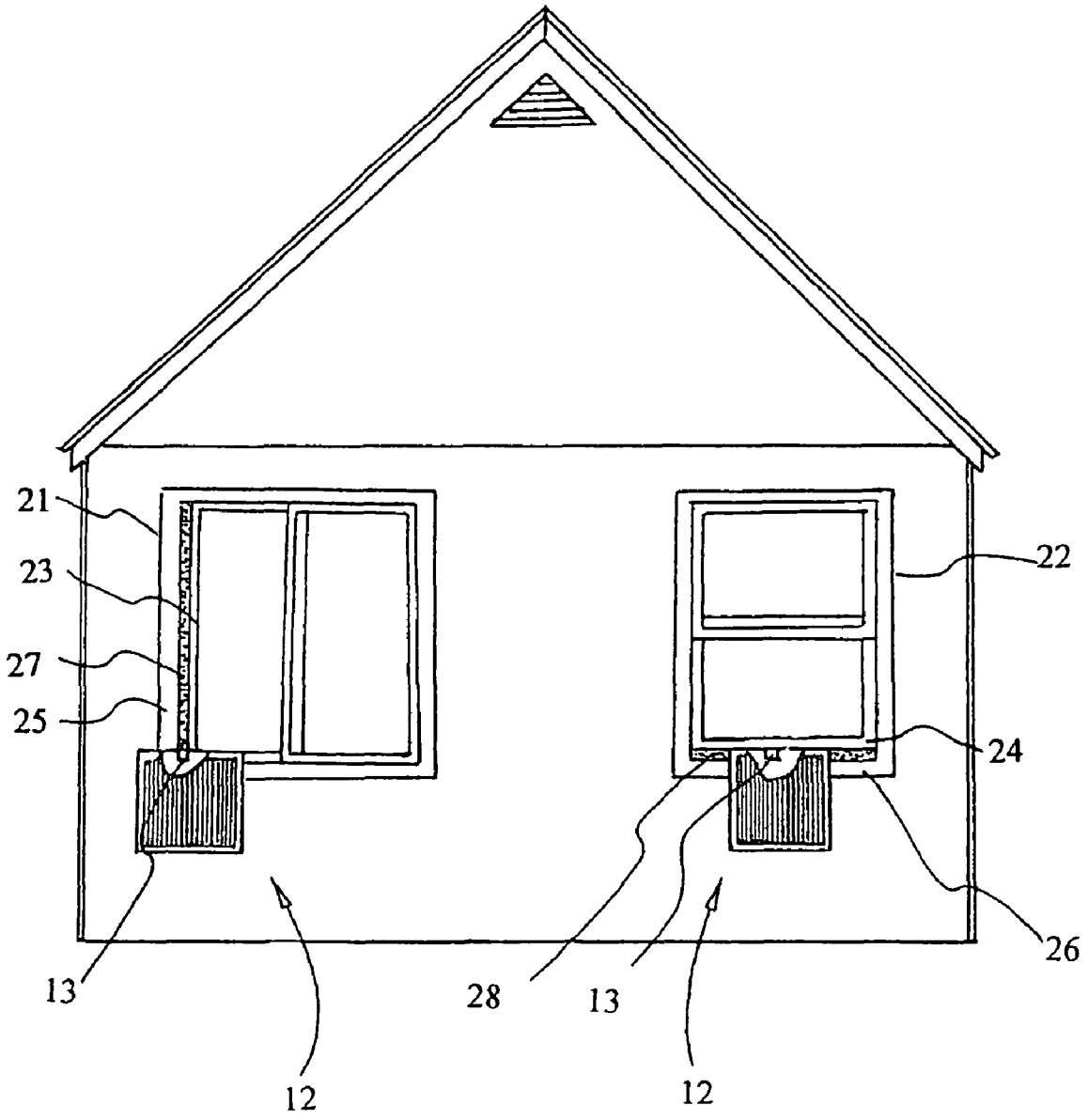
FIG. 2 illustrates the room air conditioner of the invention.

FIG. 2 illustrates the room air conditioner of the invention with portion cut showing the position the connecting rod 13 installed in a side sliding window (21) and an up & down sliding window (22). The connecting rod (13) of the air conditioner causes a gap of about 1 inch between the edge of the window panel (23 or 24) and the window frame (25) or sill (26). A strip, having has a corresponding width of the connecting rod (13), made of plastic or other suitable materials is used to fill up the gap (27 and 28).

Figure 3:
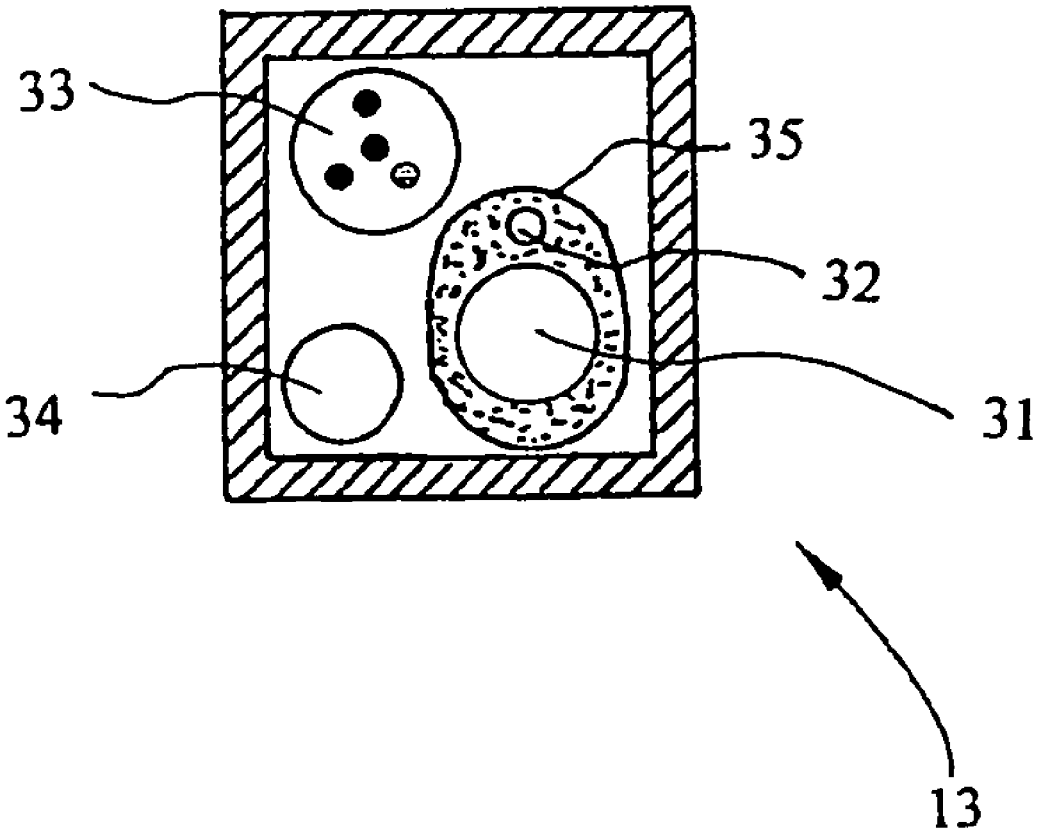
FIG. 3 is a sectional view of the connecting rod taken along line 1A-1A of FIG. 1.

FIG. 3 is a sectional view of the connecting rod (13) taken along line 1A-1A of FIG. 1. The connecting rod (13) contains suction line (31), capillary tube (32), power lines (33) and condensate line (34). An insulation (35) wraps around the suction line (31) and capillary tube (32). In this illustrated design, the capillary tube (32) passes through inside the connecting rod (13). If preferred, the capillary tube can be substituted by a liquid line. In any case, the effectiveness of the system is not affected.

Figure 4:
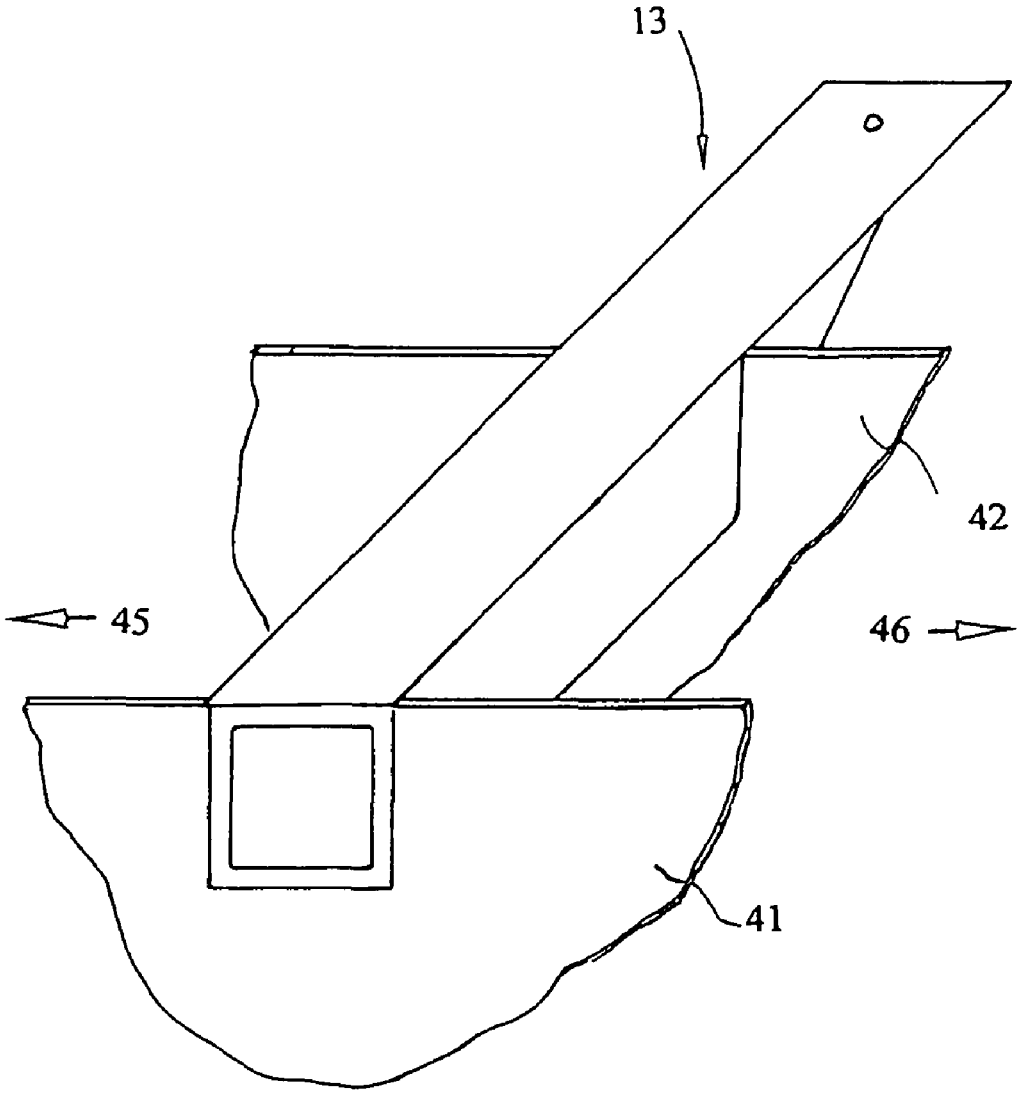
FIG. 4 illustrates the connecting rod (13) in the configuration.

FIG. 4 illustrates the connecting rod (13) in the configuration. The connecting rod, which is hollow inside, acts as a bridge through which the refrigerant tubes, electricity lines, and the condensate line pass from one end of the rod to the other. One end of the connecting rod (13) is connected to a metal side (41) of the body of the indoor housing (11); another end of the connecting rod (13) is connected to a metal side (42) of the body of the outdoor housing (12). Great progress has been made in the manufacturing of ACs that makes it possible for manufactures to produce ACs that are relatively light in weight (small unit around 40 pounds). Furthermore, with today's advanced technology in metal production, the metal used to manufacture ACs is durable and strong. The connecting rod (13) made of metal is strong enough to hold together the indoor housing (11) and outdoor housing (12). The two ends of the rod are attached to the indoor and outdoor housings at points optimal for the balance of the whole unit to avoid leaning towards the left side (45) or right side (46) when the AC is installed. In other words, the connecting rod (13) serves as a bridge for suspendedly hanging the air conditioning unit at the sill of window frame at a position that the indoor housing (11) is supported at an interior side of the window frame while the outdoor housing (12) is supported at an exterior side of the window frame.

Figure 5:
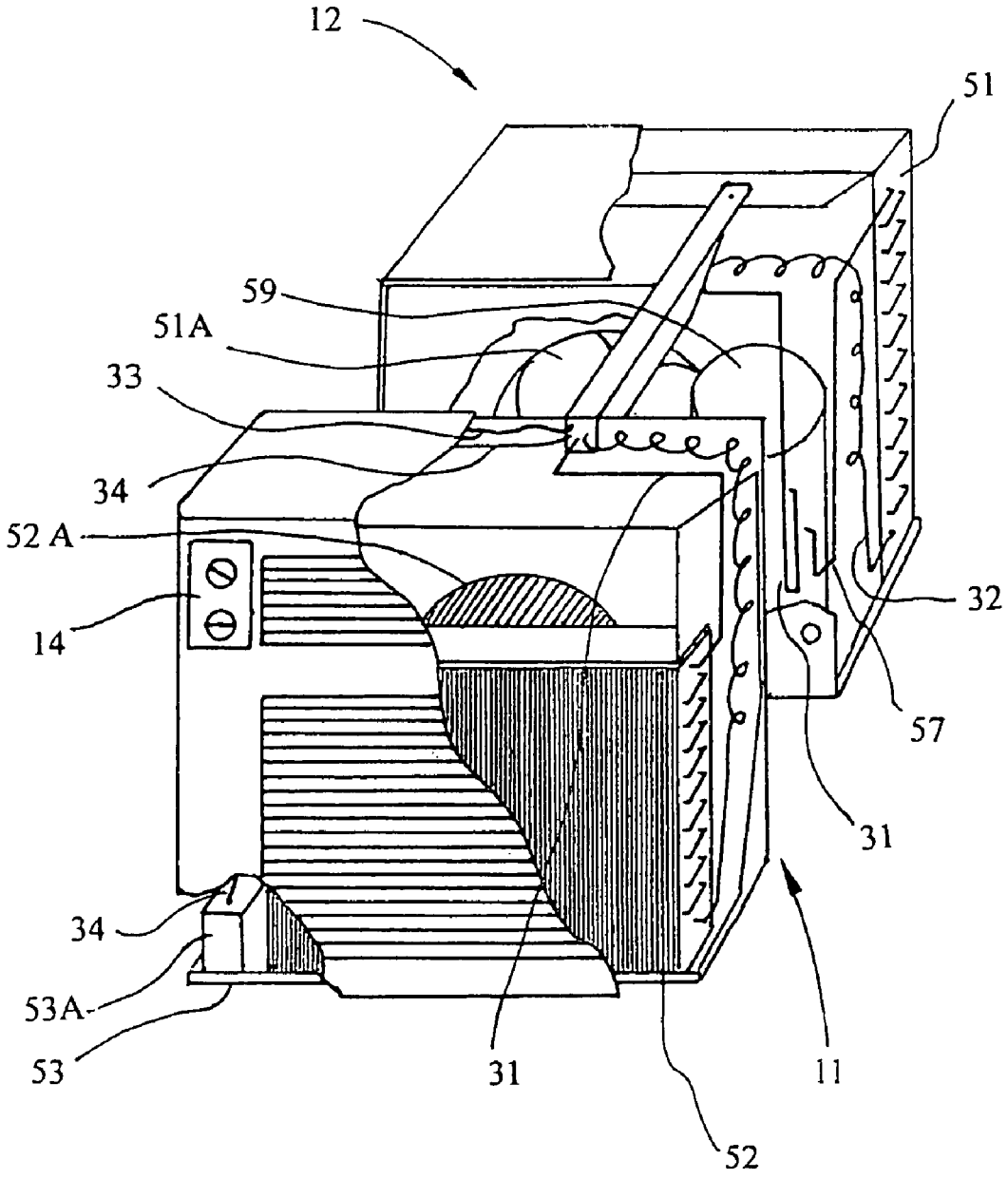
FIG. 5 is a perspective view of the invention with parts removed to reveal details of the AC unit.

FIG. 5 is a perspective view of the invention with parts removed to reveal details of the AC unit. The outdoor housing (12) contains a condenser coil (51), condenser fan (51A) and compressor (59). The indoor housing (11) contains a power control panel (14), power lines (33), an evaporator coil (52), evaporator fan (52A), condensate pan (53) and condensate remover pump (53A). During operation, the refrigerant in the evaporator coil (52) absorbs the heat from indoors. It then first travels through the suction line (31) and is compressed by the compressor (59) while traveling through the refrigerant discharge line (57) to the condenser coil (51). The heat carried by the refrigerant is at this point ejected into the air surrounding the condenser. The refrigerant, with the heat released, goes through the liquid line capillary tube (32) to the evaporator coil (52) to carry more heat before going through the cycle again. The condensate that comes from the evaporator coil (52) will drip into the bottom tray (53) of the indoor housing (11) and the condensate pan (53). The condensate removal pump unit (53A) (including water pump and water level switch) in the tray, which is controlled by a water level controlling switch (58), swings into motion when the water reaches a certain level. The activated water pump will move the condensate in the pan through the condensate line (34) to the outdoor housing. The condensate will then be evaporated by hot refrigerant condenser coil in the outdoor housing or drain out.

The above described AC operates similarly to a regular Window AC. The unique character of the present invention focuses on a physical design that allows for easy installation by users. Users are able to install the present invention by placing the connecting rod over the frame or sill of a window. With the indoor housing closely backed against the wall, the installer tightens the screws (15) on the back panel of the outdoor housing to sandwich the wall tightly for stability. Once the AC is plugged into the electrical outlet, it is ready to operate. The unique physical design of the present invention results in the described advantages to create a quiet AC unit that is easy to carry and install and consequently makes it possible for more people to enjoy the comforts of having an air conditioner. In other words, the screws (15) are provided at the outdoor housing (12) for adjustably biasing against a wall of the window frame at the exterior side thereof until the indoor housing (11) is placed close to the wall of the window frame at the interior side thereof.

The above described AC operates similarly to a regular Window AC. The unique character of the present invention focuses on a physical design that allows for easy installation by users. Users are able to install the present invention by placing the connecting rod over the frame or sill of a window. With the indoor housing closely backed against the wall, the installer tightens the screws (15) on the back of the outdoor housing to sandwich the wall tightly for stability. Once the AC is plugged into the electrical outlet, it is ready to operate. The unique physical design of the present invention results in the described advantages to create a quiet AC unit that is easy to carry and install and consequently makes it possible for more people to enjoy the comforts of having an air conditioner.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A window air conditioner for mounting at an existing window frame, comprising:

an indoor housing;

an outdoor housing;

an air conditioning unit comprising a first means for removing heat from indoors at said indoor housing, a second means for releasing said heat to outdoors at said outdoor housing, and a power control panel provided at said indoor housing to control said first and second means, wherein said first means comprises an evaporator coil, an evaporator fan, and a condensate remover pump, wherein said second means comprises a condenser coil, a condenser fan, and a compressor;

a single connecting rod having a hollow structure extended between said indoor housing and said outdoor housing, wherein said connecting rod has a predetermined size substantially smaller than a width of each of said indoor housing and outdoor housing; wherein said connecting rod serves as a bridge for suspendedly hanging said air conditioning unit at said window frame at a position that said indoor housing is supported at an interior side of said window frame while said outdoor housing is supported at an exterior side of said window frame, wherein said hollow structure forms a channel that said first means is operatively connected to said second means through said channel of said connecting rod, wherein two ends of said connecting rod are secured to metal sides of said indoor and outdoor housings respectively at a point to keep the balance between that said indoor and outdoor housings, wherein said connecting rod also forms means for carrying said indoor and outdoor housings;

a capillary tube, a power line, a suction line, and a condensate line running through said connecting rod to operatively couple said first means in said outdoor housing with said second means at said indoor housing; and an insulation wrapping around said suction line and said capillary tube within said connecting rod to prevent absorption of heat, wherein said first means further comprises a water pump controlled by a water level controlling switch and arranged in such a manner that when water reaches a certain level, said water pump is activated to pump said water in said indoor housing to said outdoor housing through said condensate line;

wherein said window air conditioner is adapted for being installed into said existing window frame with either horizontal sliding window or vertical sliding window to minimize a gap with respect to the size of said connecting rod, wherein said gap formed by sliding said horizontal sliding window to close said existing window frame is about the same as said gap formed by sliding said vertical sliding window to close said existing window frame;

whereby a user is capable of mounting said air conditioning unit through the use of said connecting rod without substantially and structurally modifying said existing window frame;

whereby, said window air conditioner is adapted for being installed into said existing window frame with horizontal sliding window by positioning said connecting rod at the furthest end of end of said horizontal sliding window such that there is a gap about the width of said connecting rod when said horizontal sliding window is slid to close, so as to minimize the gap with respect to the size of said connecting rod;

whereby, said window air conditioner is adapted for being installed into said existing window frame with vertical sliding window by positioning said connecting rod at a sill of said window frame, such that there is a gap about the height of said connecting rod when said vertical sliding window is slid to close, so as to minimize the gap with respect to the size of said connecting rod.

2. The window air conditioner, as recited in claim 1, further comprising a strip having a corresponding width and height of said connecting rod for shielding the gap of said window frame when said connecting rod is hanged at said window frame.

3. The window air conditioner, as recited in claim 1, further comprising a plurality of screws are provided at said outdoor housing for adjustably biasing against a wall of said window frame at said exterior side thereof until said indoor housing is placed close to said wall of said window frame at said interior side thereof.

4. The window air conditioner, as recited in claim 2, further comprising a plurality of screws are provided at said outdoor housing for adjustably biasing against a wall of said window frame at said exterior side thereof until said indoor housing is placed close to said wall of said window frame at said interior side thereof.

5. A method of installing an air conditioner into a window frame, comprising the steps of:

(a) hanging a connecting rod over a sill of said window frame; and (b) positioning an outdoor housing at an exterior side of said window frame while positioning an indoor housing at an interior side of said window, wherein said connecting rod extends between said indoor housing and said outdoor housing at a point that said indoor housing and said outdoor housing are in balance manner, wherein said connecting rod has a predetermined size smaller than a width of each of said indoor housing and outdoor housing, wherein said indoor housing houses a first means for removing heat from indoors at said indoor housing, wherein said outdoor housing houses a second means for releasing said heat to outdoors at said outdoor housing, wherein said connecting rod, having a hollow structure, forms a channel that said first means is operatively connected to said second means through said channel of said connecting rod;

(c) closing a sliding window to minimize a gap with respect to the size of said connecting rod, wherein when said window air conditioner is installed into said existing window frame with horizontal sliding window, said connecting rod is positioned at the furthest end of end of said horizontal sliding window such that there is a gap about the width of said connecting rod when said horizontal sliding window is slid to close, wherein when said window air conditioner is installed into said existing window frame with vertical sliding window, said connecting rod is positioned at the sill of said window frame, such that there is a gap about the height of said connecting rod when said vertical sliding window is slid to close, so as to minimize the gap with respect to the size of said connecting rod, wherein said gap formed by sliding said horizontal sliding window to close said existing window frame is about the same as said gap formed by sliding said vertical sliding window to close said existing window frame;

(d) shielding the gap of said window frame via a strip when said connecting rod is hanged at said window frame, wherein said strip has a corresponding width and height of said connecting rod.

6. The method as recited in claim 5, wherein said step (b) further comprises the steps of:

(b.1) placing said indoor housing close to a wall of said window frame at said interior side thereof; and (b.2) adjusting a plurality of screws at said outdoor housing to bias against said wall of said window frame at said exterior side thereof.

7. The method, as recited in claim 5, wherein said first means comprises an evaporator coil, an evaporator fan, and a condensate remover pump, and said second means comprises a condenser coil, a condenser fan, and a compressor, wherein said window air conditioner further comprises a suction line, a capillary tube, a power line and a condensate line running through said connecting rod to operatively couple said first means in said outdoor housing with said second means at said indoor housing, wherein said first means further comprises a water pump controlled by a water level controlling switch and arranged in such a manner that when water reaches a certain level, said water pump is activated to pump said water in said indoor housing to said outdoor housing through said condensate line, wherein an insulation wraps around said suction line and said capillary tube within said connecting rod to prevent absorption of heat.

8. The method, as recited in claim 6, wherein said first means comprises an evaporator coil, an evaporator fan, and a condensate remover pump, and said second means comprises a condenser coil, a condenser fan, and a compressor, wherein said window air conditioner further comprises a suction line, a capillary tube, a power line and a condensate line running through said connecting rod to operatively couple said first means in said outdoor housing with said second means at said indoor housing, wherein said first means further comprises a water pump controlled by a water level controlling switch and arranged in such a manner that when water reaches a certain level, said water pump is activated to pump said water in said indoor housing to said outdoor housing through said condensate line, wherein an insulation wraps around said suction line and said capillary tube within said connecting rod to prevent absorption of heat.

* * * * *